US011109702B2

(12) United States Patent
Abraham

(10) Patent No.: US 11,109,702 B2
(45) Date of Patent: Sep. 7, 2021

(54) CLEAR HANGER

(71) Applicant: Ezekiel M. Abraham, Brooklyn, NY (US)

(72) Inventor: Ezekiel M. Abraham, Brooklyn, NY (US)

( * ) Notice: Subject to any disclaimer, the term of this patent is extended or adjusted under 35 U.S.C. 154(b) by 0 days.

(21) Appl. No.: 15/467,062

(22) Filed: Mar. 23, 2017

(65) Prior Publication Data

US 2018/0271312 A1 Sep. 27, 2018

(51) Int. Cl.
*A47G 25/36* (2006.01)
*A47G 25/28* (2006.01)

(52) U.S. Cl.
CPC ..... *A47G 25/36* (2013.01); *A47G 25/28* (2013.01)

(58) Field of Classification Search
CPC ..... A47G 25/20; A47G 25/28; A47G 25/36
See application file for complete search history.

(56) References Cited

U.S. PATENT DOCUMENTS 1,743,234 A * 1/1930 Porter ..... A47G 25/32 223/94
2,062,566 A 12/1936 Fletcher et al.
2,310,058 A * 2/1943 Bolten ..... A47G 25/28 223/88
D140,337 S 2/1945 Hill
D140,399 S 2/1945 Leifer et al.
3,194,458 A * 7/1965 Bennett ..... A47G 25/28 223/92
3,702,166 A 1/1972 Jaffe
3,666,149 A * 5/1972 Woodhull ..... A47G 25/32 223/85
D234,737 S * 4/1975 Scott et al. ..... D6/319
4,261,490 A * 4/1981 Schwartzstein ..... A47G 25/183 223/88
5,509,587 A * 4/1996 Gouldson ..... A47G 25/28 223/85
5,947,349 A * 9/1999 Shaalan ..... D06F 89/023 223/37
6,053,377 A * 4/2000 Beverly ..... A47G 25/28 223/85
6,196,430 B1 * 3/2001 Gouldson ..... A47G 25/48 223/91
D499,559 S 12/2004 Schultz et al.
7,731,068 B2 6/2010 Scicluna
(Continued)

FOREIGN PATENT DOCUMENTS

CN 200630047945.5 2/2007
CN 200930263370.4 6/2010
(Continued)

OTHER PUBLICATIONS

Amazon.com, Inc., "AmazonBasics Velvet Suit Hangers", Mar. 7, 2014, online, <https://www.amazon.com/AmazonBasics-Velvet-Suit-Hangers-Black/dp/B00FXNAAW2#customerReviews>.
(Continued)

*Primary Examiner* — Nathan E Durham
(74) *Attorney, Agent, or Firm* — Gottlieb, Rackman & Reisman, PC

(57) ABSTRACT

A completely clear hanger that has a thickness that is between about 0.19 and 0.40 inches. By being completely clear, the hanger is adaptable for use with any décor and takes a minimal amount of space in a closet or other storage area.

5 Claims, 5 Drawing Sheets

(56) References Cited

U.S. PATENT DOCUMENTS

| | | | | |
|---|---|---|---|---|
| D650,177 | S | 12/2011 | Kimpton | |
| D667,644 | S * | 9/2012 | Wei | D6/318 |
| D735,481 | S | 8/2015 | Jones | |
| D737,581 | S * | 9/2015 | Li | D6/319 |
| 9,247,838 | B2 | 2/2016 | Kallet | |
| 9,295,351 | B2 | 3/2016 | Schaffer | |
| 2009/0095778 | A1* | 4/2009 | Perez | A47G 25/4023 223/94 |
| 2010/0193551 | A1* | 8/2010 | Gouldson | A47G 25/48 223/91 |
| 2010/0193552 | A1* | 8/2010 | Gouldson | A47G 25/28 223/92 |
| 2010/0288799 | A1* | 11/2010 | Liscano | A47G 25/1414 223/85 |
| 2011/0057001 | A1* | 3/2011 | Louw | A47G 25/485 223/85 |
| 2013/0228598 | A1* | 9/2013 | Xie | A47G 25/60 223/86 |
| 2015/0021367 | A1* | 1/2015 | Schaffer | A47G 25/36 223/85 |
| 2016/0157651 | A1* | 6/2016 | Levin | A47G 25/403 223/85 |

FOREIGN PATENT DOCUMENTS

| | | | |
|---|---|---|---|
| CN | 204520190 | U | 8/2015 |
| CN | 105380486 | A | 3/2016 |
| CN | 205597696 | U | 9/2016 |
| CN | 205728965 | U | 11/2016 |
| CZ | 1968-3709 | | 6/1968 |
| CZ | 002019265-0002 | | 4/2012 |
| JP | 10-216000 | | 8/1998 |
| WO | 2016154152 | | 9/2016 |

OTHER PUBLICATIONS

Appendini Shop, "Transparent Hangers Mod. FO/W", Jul. 2, 2012, <http://www.appendini-shop.it/index.php?main_page=index&cPath=167>.

* cited by examiner

CLEAR HANGER

FIELD OF THE INVENTION

The present invention relates generally to hanger and more particularly to an entirely clear and very thin, space saving hanger.

BACKGROUND OF THE INVENTION

Garment hangers of various shapes, sizes and designs are known. These include hangers that are constructed substantially of a plastic, metal and wood and can include non-slip material or padding.

One known non-slip hanger design is flocked in velvet. This hanger is relatively inexpensive and available in a variety of colors (black, ivory, pink, blue, etc.) depending on a customer's preference. The velvet material aids in preventing silk clothing or clothing with a larger neck opening from slipping off the hanger.

Another known hanger is comprised of acrylic or plastic and typically is about one and a half inches thick. This hanger, due to its width, is commonly used at retail locations but it does not allow for space savings in one's closet.

Yet another known hanger is comprised of acrylic or plastic and typically is about one and three quarter inches thick. This hanger is relatively expensive and is typically used at retail locations and/or to hang special garments as it takes up a considerable amount of space in one's closet.

Currently, no hanger design exists that is affordable, completely clear and very thin.

SUMMARY OF THE INVENTION

The present invention is directed to a completely clear, thin hanger. That is, a hanger that is free of any coloring, is not opaque and not covered by any material that would prohibit the hanger from being entirely clear. As noted above, several hanger configurations are known. However, no design currently combines a body that is entirely clear and has a very thin thickness.

The hanger of the invention is not only a space saver, but affords the user with the ability to use it in any color environment. The hanger of the invention takes on its environments color, without conflicting with any existing décor (like a pink hanger may do in an orange closet), while simultaneously saving space and providing more room in the user's closet. It is this combined benefit of being completely clear and neutral in presentation, and space saving that makes the inventive clothes hanger unique.

In an embodiment, the present invention is directed to a hanger that comprises a body that is completely clear and has a thickness that is between about 0.19 and 0.40 inches. In an embodiment, the thickness of the body is about 0.19 inches.

The body can include a base that extends between a first end and a second end, a first sidewall that is contiguous to and extends at a first angle from the first end of the base and a second sidewall that is contiguous to and extends at a second angle from the second end of the base toward the first sidewall, a first upper portion that extends contiguous to and at a third angle from the first sidewall, a second upper portion that extends contiguous to and at a fourth angle from the second sidewall toward the first upper portion and a third upper portion that is curved and extends between the first upper portion and the second upper portion to form a seamless, unitary, continuously extending element.

The hanger can include a hook that extends from the body and that is configured to support the hanger on a structure. The hanger can also include a first groove that extends from a first surface of the first upper portion toward a second surface of the first upper portion that is opposite the first surface of the first upper portion and a second groove that extends from a first surface of the second upper portion toward a second surface of the second upper portion that is opposite the first surface of the second upper portion.

In an embodiment, the body can be comprised of a polymeric material and a substantially rigid plastic. In another embodiment, the body is comprised of an acrylic material.

DETAILED DESCRIPTION OF EMBODIMENTS OF THE INVENTION

Figure 1:
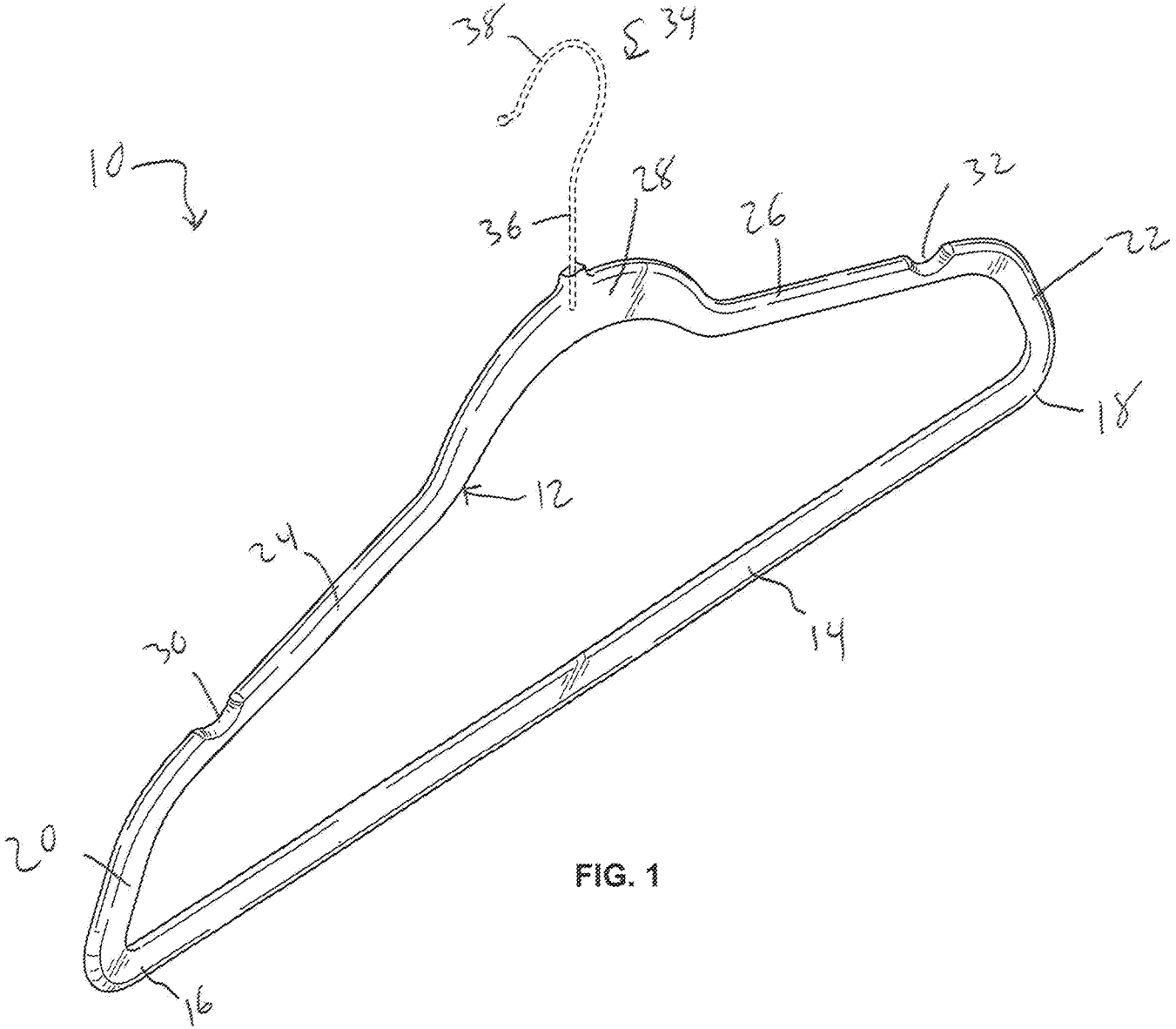
FIG. 1 is a perspective view of an embodiment of a clear hanger of the present invention.
Figure 2:
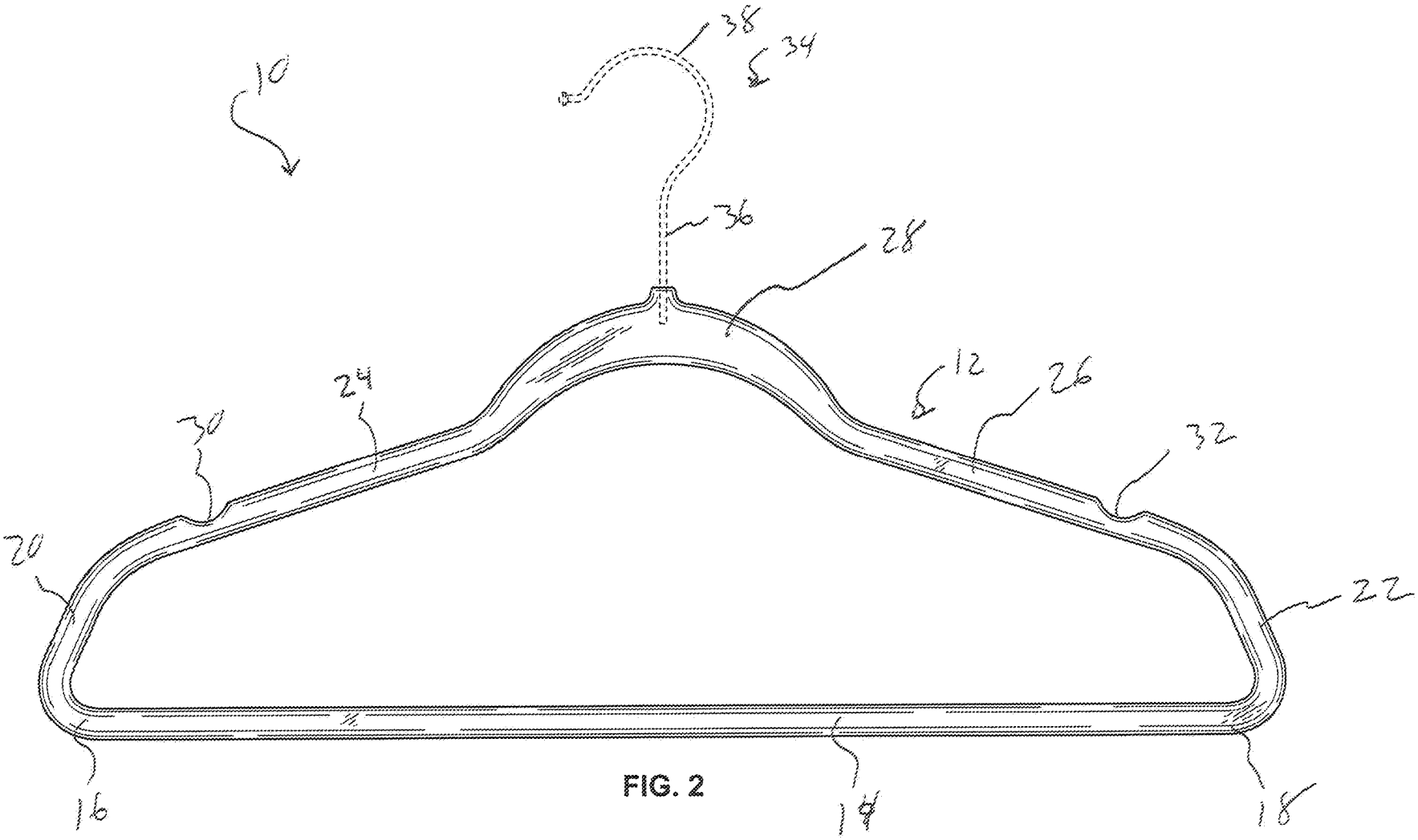
FIG. 2 is a front view of the clear hanger of FIG. 1.
Figure 3:
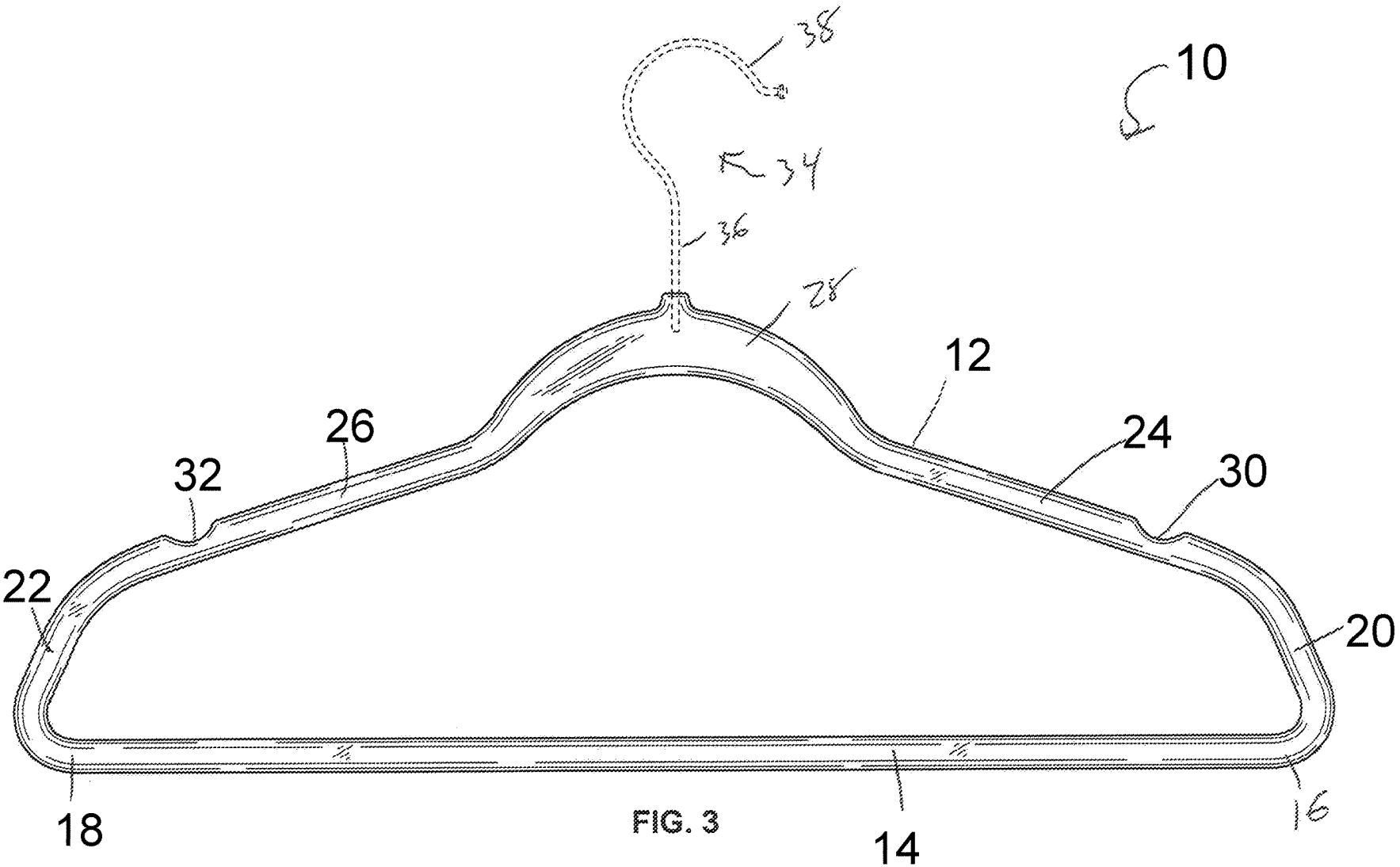
FIG. 3 is a rear view of the clear hanger of FIG. 1.
Figure 5:
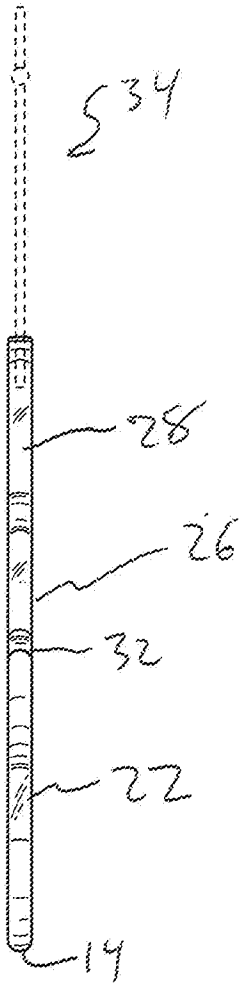
FIGS. 4 and 5 is a side views of the clear hanger of FIG. 1.
Figure 4:
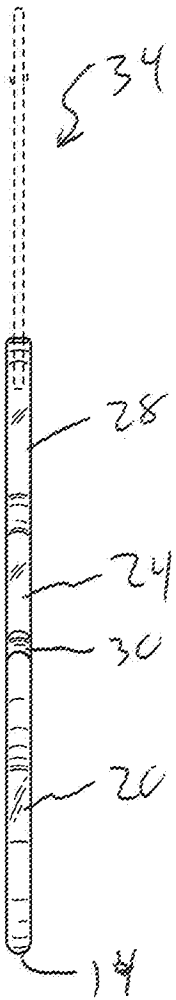
Figure 6:
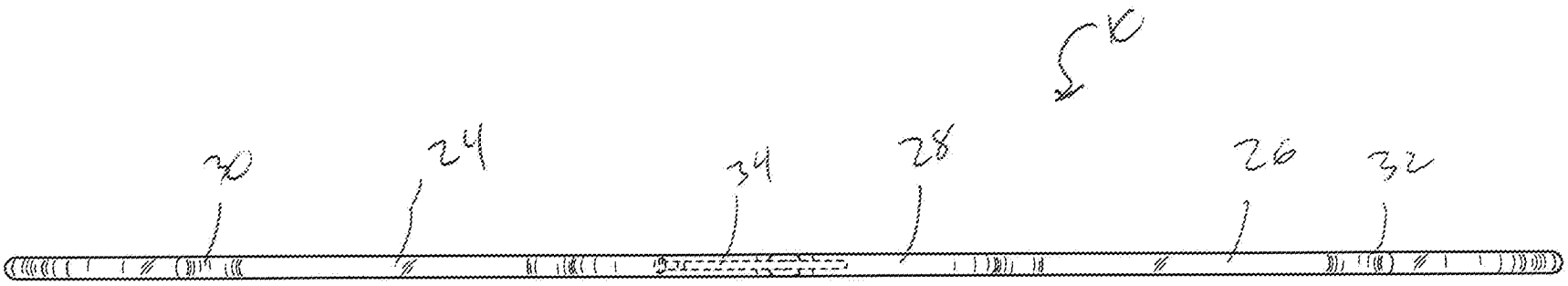
FIG. 6 is a top view of the clear hanger of FIG. 1.
Figure 7:
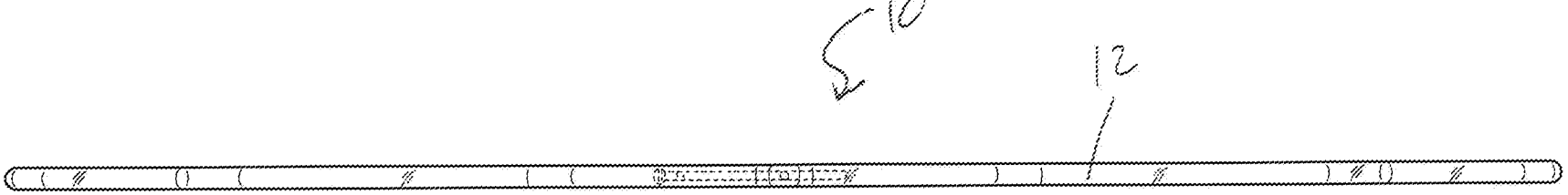
FIG. 7 is a bottom view of the clear hanger of FIG. 1.

With reference now to the drawings, and in particular to FIGS. 1 through 7, an embodiment of a hanger embodying the principles and concepts of the present invention, which is generally designated by the reference numeral 10, will be described.

As depicted in FIGS. 1-7, the hanger 10 includes a body 12 that is comprised of an acrylic, polymer or plastic that is entirely clear. By designing the hanger 10 to be entirely clear, one can utilize the hangers 10 in any room décor. The body 12 is configured to be a substantially rigid structure such that the hanger 10 is not foldable.

In an embodiment, the hanger 10 is between about 0.19 and 0.40 inches thick. In another embodiment, the hanger the hanger 10 is about 0.19 inches thick. By designing the hanger 10 to be very thin, the space required in one's closet for each hanger is substantially minimized, allowing for twice or three times as many hangers and garments to be hung in said closet.

The hanger 10 includes a body 12 that has a base 14 that extends between a first end 16 and a second end 18, a first sidewall 20 that is contiguous to and extends at a first angle from the first end 16 of the base 14 and a second sidewall 22 that is contiguous to and extends at a second angle from the second end 18 of the base 14 toward the first sidewall 20, a first upper portion 24 that extends contiguous to and at a third angle from the first sidewall 20, a second upper portion 26 that extends contiguous to and at a fourth angle from the second sidewall 22 toward the first upper portion 24 and a third upper portion 28 that is curved and extends between the first upper portion 24 and the second upper portion 26 to form a seamless, unitary, continuously extending element.

The first upper portion 24 and the second upper portion 26 together are configured to support a garment. In an embodiment, the first upper portion 24 includes a first depression 30 and the second upper portion 26 includes a second depression 32 to aid in supporting straps associated with a garment. The first upper portion 24 and the second upper portion 26 are of identical length to ensure uniformity when hanging a garment so that the weight of the garment can be equally distributed.

The hanger 10 further includes a hook 34 for supporting the hanger 10 from a rod in a closet or a similar structure. The hook 34 is comprised of a neck 36 extending from the body 12 of the hanger 10 and a curved portion 38.

The accompanying drawings illustrate an embodiment of a completely clear hanger and its respective constituent parts, however, other types and styles are possible, and the drawings are not intended to be limiting in that regard. Thus, although the description above and accompanying drawings contains much specificity, the details provided should not be construed as limiting the scope of the embodiment, but merely as providing illustrations of some of the features of the embodiment. The drawings and the description are not to be taken as restrictive on the scope of the embodiment and are understood as broad and general teachings in accordance with the present invention. While the present embodiment has been described using specific terms, such description is for illustrative purposes only, and it is to be understood that modifications and variations to such embodiment, including, but not limited to, the substitutions of equivalent features, materials, or parts, and the reversal of various features thereof, may be practiced by those of ordinary skill in the art without departing from the spirit and scope of the invention.

What is claimed is:

1. A hanger, comprising:

a body that includes a base that is devoid of any surface ornamentation, that extends between a first end and a second end and that includes an upper portion and a lower portion that is mirror image of the upper portion at least along an entirety of a linearly extending segment of the upper portion, a first sidewall that is contiguous to and extends at a first angle from the first end of the base and extends at least in part linearly between a first end and a second end thereof and a second sidewall that is contiguous to and extends at a second angle from the second end of the base toward the first sidewall and extends at least in part linearly between a first end and a second end thereof, a first upper portion that is contiguous to and extends at a third angle from the first sidewall, a second upper portion that is contiguous to and extends at a fourth angle from the second sidewall toward the first upper portion and a third upper portion that is curved at both a top surface and a bottom surface thereof with the bottom surface extending at least at an apex thereof above an upper surface of the first portion and an upper surface of the second portion and the third upper portion extending between the first upper portion and the second upper portion to form a seamless, unitary, continuously extending one-piece element; and a hook entirely devoid of any covering extending from the body that is configured to support the hanger on a structure and comprising a neck, delimited between a first end and a second end, extending at the first end thereof from the body and a curved portion, delimited between a first end and a second end, extending at the first end thereof from the second end of the neck, wherein the first upper portion has a single depression that is delimited between a first edge that extends, at a first location, between a front surface and a rear surface of the first upper portion where the first edge connects with the upper surface of the first upper portion and a second edge that extends, at a second location, that is spaced from the first location, between the front surface and the rear surface of the first upper portion where the second edge connects with the upper surface of the first upper portion and that extends convexly from a top surface of the first upper portion toward a bottom surface of the first upper portion and the base with the first edge and the second edge spaced away from a lowest point of the depression, the lowest point being a point about a curvature of the depression that is furthest from the top surface, the second upper portion has a single depression that is delimited between a first edge that extends, at a first location, between a front surface and a rear surface of the second upper portion where the first edge connects with the upper surface of the second upper portion and a second edge that extends, at a second location, that is spaced from the first location, between the front surface and the rear surface of the second upper portion where the second edge connects with the upper surface of the second upper portion that extends from a first surface thereof toward a bottom surface of the second upper portion and the base and the third upper portion is entirely devoid of an opening therein exclusive of a receptacle for the hook, the receptacle having a protrusion extending at an apex of a top surface of the third upper portion toward the hook, and wherein the body is completely clear and has a thickness that is between 0.19 and 0.40 inches.

2. The hanger of claim 1, wherein the thickness of the body is about 0.19 inches.

3. The hanger of claim 1, wherein the body is comprised of a polymeric material.

4. The hanger of claim 1, wherein the body is comprised of a plastic.

5. The hanger of claim 1, wherein the body is comprised of an acrylic material.

* * * * *